United States Patent [19]

Unno et al.

[11] Patent Number: 4,502,458

[45] Date of Patent: Mar. 5, 1985

[54] APPARATUS FOR TRUING A GRINDING WHEEL

[75] Inventors: Kunihiko Unno; Toshio Tsujiuchi; Yukio Oda, all of Kariya, Japan

[73] Assignee: Toyoda Koki Kabushiki Kaisha, Kariya, Japan

[21] Appl. No.: 459,217

[22] Filed: Jan. 19, 1983

[30] Foreign Application Priority Data

Feb. 15, 1982 [JP] Japan ..... 57-18580[U]

[51] Int. Cl.[3] ..... B24B 53/06

[52] U.S. Cl. ..... 125/11 R; 51/165.71; 125/11 TP

[58] Field of Search ..... 125/11 R, 11 TP, 11 CD, 125/11 PH; 51/165.71

[56] References Cited

U.S. PATENT DOCUMENTS 3,009,455 11/1961 Price ..... 125/11 R
4,103,668 8/1978 Nishimura ..... 125/11 CD
4,160,438 7/1979 Fujita ..... 125/11 TP

FOREIGN PATENT DOCUMENTS 1129033 5/1962 Fed. Rep. of Germany .... 125/11 R

*Primary Examiner*—Harold D. Whitehead
*Attorney, Agent, or Firm*—Oblon, Fisher, Spivak, McClelland & Maier

[57] ABSTRACT

An apparatus for truing a grinding wheel includes a stylus movable in response to movement of a truer in synchronism therewith, and a template disposed in confronting relation to the stylus with a gap left therebetween. The truer is controlled in its motion by servomotors driven in response to a command issued from a numerical control unit. When the truer is caused by the numerical control unit to move out of control for some reasons, the stylus is brought into engagement with the template, thereby protecting the truer and a grinding wheel being trued thereby against damage which would otherwise result from such uncontrolled movement of the truer. When the truer is to be advanced for truing infeed against the grinding wheel, the stylus is disconnected by a clutch device from the truer, and only the truer is moved in the forward direction while maintaining a proper gap between the stylus and the template.

11 Claims, 3 Drawing Figures

APPARATUS FOR TRUING A GRINDING WHEEL

BACKGROUND OF THE INVENTION

The present invention relates to an apparatus for truing a grinding wheel rotatably supported on a grinding machine.

Conventional apparatus for truing or dressing straight and arcuate surfaces of grinding wheels on grinding machines utilize a hydraulic cylinder for moving a truer through a mechanism, which is complex and difficult to adjust. There has accordingly been a need for controlling movement of the truer with a numerical control unit. However, the numerically controlled truer could damage the grinding wheel and itself if a servomotor that moves the truer ran out of control for some reasons.

SUMMARY OF THE INVENTION

It is an object of the present invention to mechanically confine movement of a truer for safety when the truer moves out of control while a grinding wheel is being trued under numerical control.

Another object of the present invention is to provide an apparatus for truing a grinding wheel, which apparatus has a safety template for mechanically confining movement of a truer when the latter moves out of control while under control of a numerical control unit, thus protecting the grinding wheel against damage.

According to the present invention, an apparatus for truing a grinding wheel having a grinding surface, comprises a base, a support movably mounted on the base for movement in a first direction parallel to the grinding surface, a carrier movably supported on the support for movement in a second direction perpendicular to the first direction, a truer supported on the carrier, first and second feed means for respectively moving the support and the carrier during a truing operation in which the grinding wheel is being trued by the truer, a stylus supported on the support and movable in the second direction, synchronous drive means for moving the stylus in synchronism with the movement of the carrier during the truing operation, and a safety template mounted on the base in confronting relation to the stylus with a gap defined therebetween during the truing operation. The stylus can abut against the template only when the carrier is excessively fed toward the grinding wheel due to malfunction of the second feed means, thereby preventing the stylus and the carrier from further moving toward the grinding wheel.

The above and other objects, features and advantages of the present invention will become more apparent from the following description when taken in conjunction with the accompanying drawings in which a preferred embodiment of the present invention is shown by way of illustrative example.

DETAILED DESCRIPTION

Figure 1:
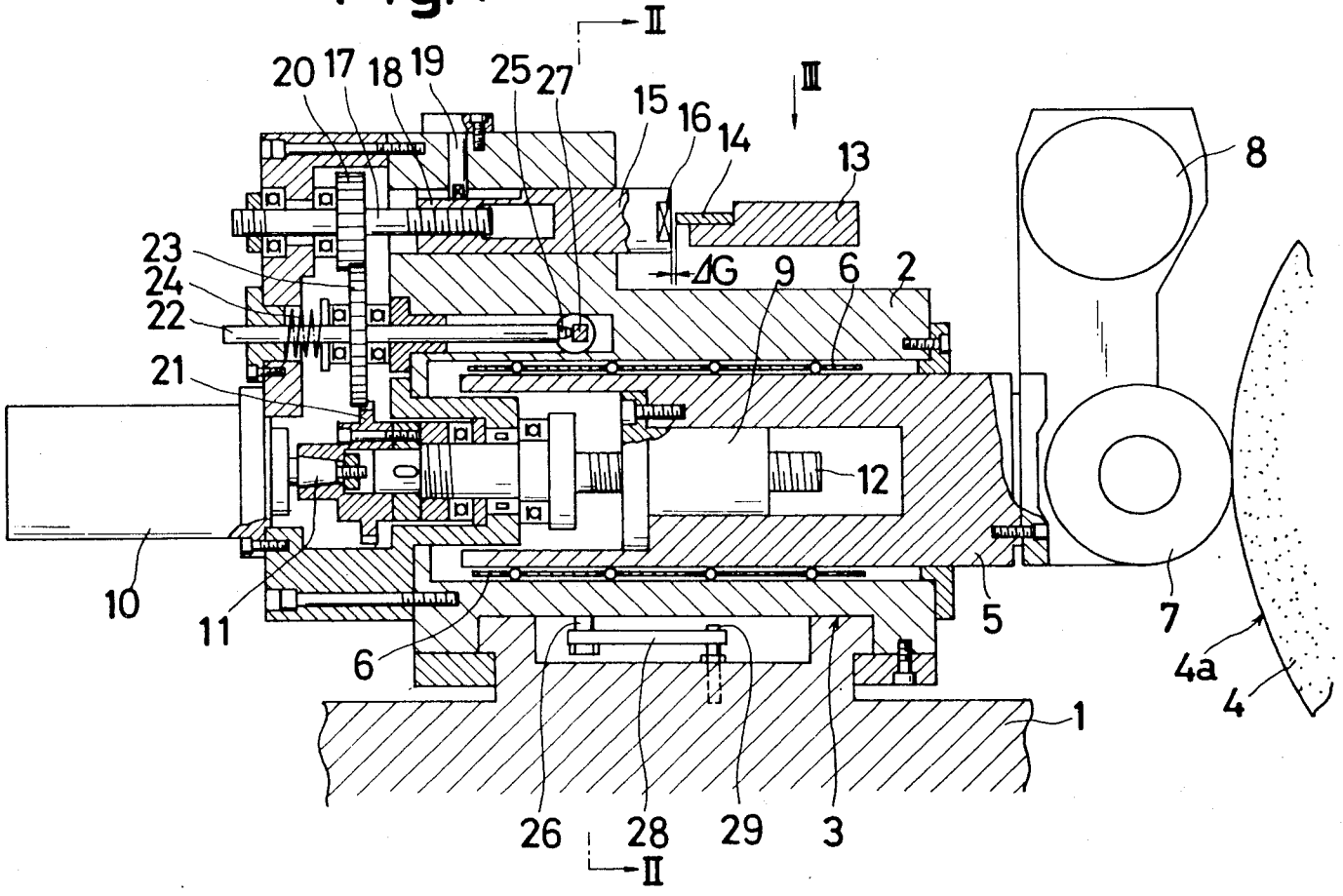
FIG. 1 a longitudinal cross-sectional view of a truing apparatus according to the present invention.
Figure 2:
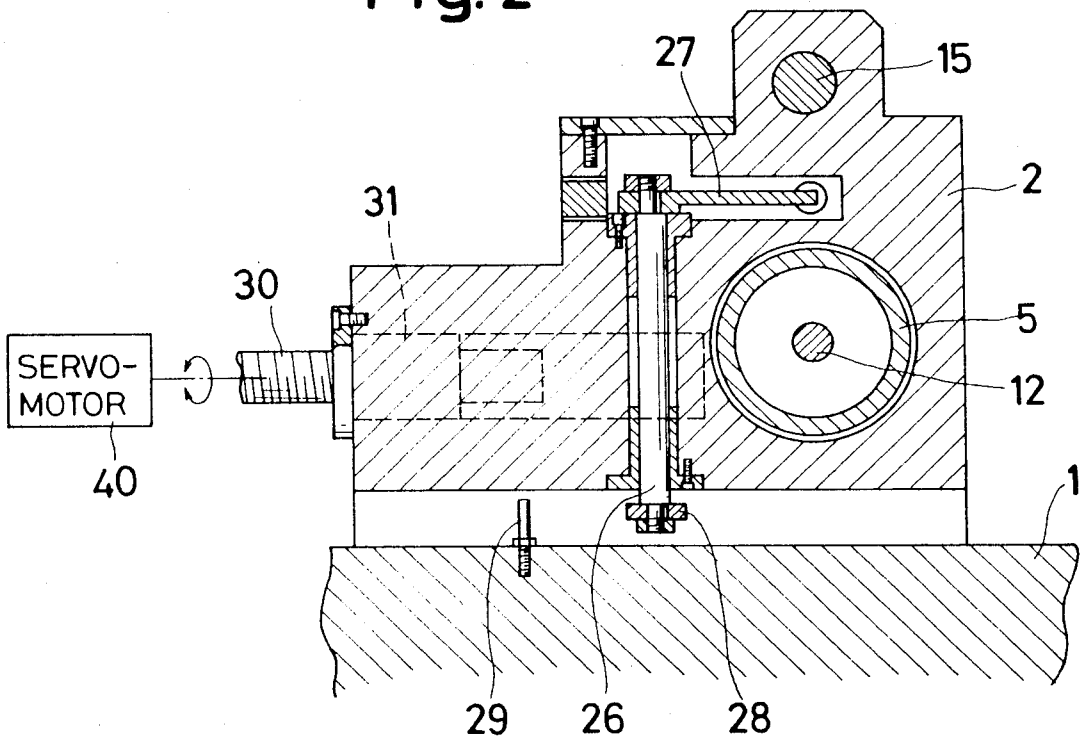
FIG. 2 is a cross-sectional view taken along line II—II of FIG. 1.
Figure 3:
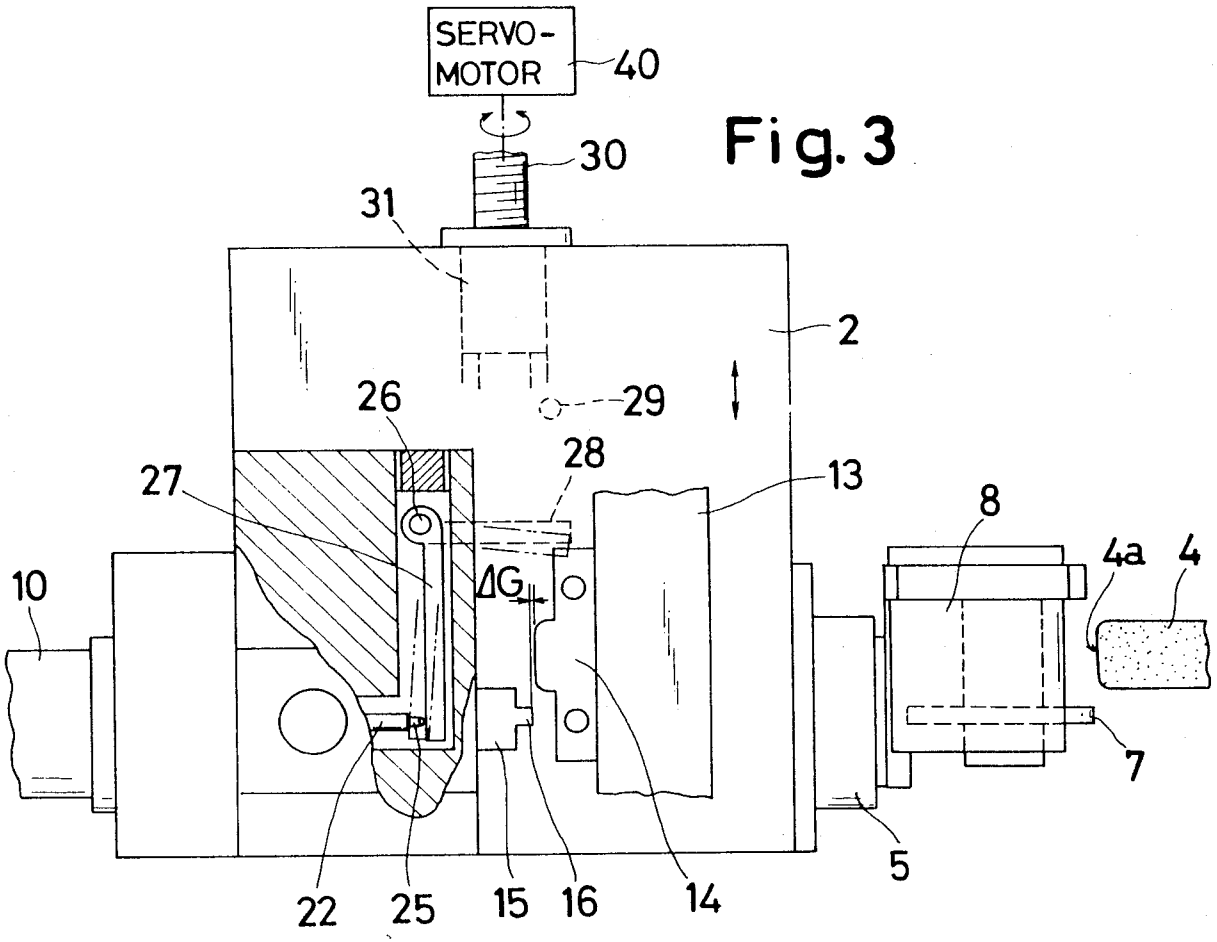
FIG. 3 is a plan view of the truing apparatus as seen from the direction indicated by the arrow III of FIG. 1.

As shown in FIGS. 1 and 2, a table or a grinding wheel base 1 supports thereon a support or body 2 of a truing apparatus, which is slidably mounted on and guided by slide ways 3 on the table 1 for sliding movement parallel to the axis of a grinding wheel 4 or a grinding surface 4*a* thereof. The body 2 is movable by the feed screw 30 (FIG. 3) which is rotatable about its own axis by a servomotor 40, the feed screw 30 being threaded through a nut 31 mounted in the body 2.

A truer ram 5 serving as a carrier is mounted in the body 2 and axially movable back and forth in a direction perpendicular to the axis of the grinding wheel 4. The truer ram 5 is surrounded by a stroke bearing 6 which serves as a friction reducing means for allowing the truer ram 5 to smoothly move back and forth in the body 2. A truer 7 is rotatably supported on a distal end of the truer ram 5 which faces the grinding wheel 4, the truer 7 comprising a diamond wheel which is rotatable by a motor 8.

The truer ram 5 is axially movable back and forth by an actuator mechanism which comprises a feed screw shaft 12 threaded through a nut 9 fixedly mounted in the truer ram 5, a servomotor 10 fastened to the body 2 and having an output shaft 11 coupled to the feed screw shaft 12.

The body 2 also supports a stylus shaft 15 positioned upwardly of the truer ram 5 and axially movable back and forth in the same direction as that of movement of the truer shaft 5, the stylus shaft 15 having a stylus 16 on its distal end. The stylus shaft 15 is axially movable back and forth in synchronism with axial movement of the truer shaft 5 through a mechanism, which comprises a feed screw shaft 17 threaded through a nut 18 formed in the stylus shaft 15 and having a driven gear 20 mounted thereon, a drive gear 21 fixed to the feed screw shaft 12 threadedly engaged with the truer shaft 5, and an intermediate gear 23 interposed between and held in mesh with the drive and driven gears 21, 20. The intermediate gear 23 is mounted on a clutch shaft 22 of a clutch device (described later). When the clutch device is actuated, the intermediate gear 23 is axially shifted out of mesh with the drive gear 21 while maintaining meshing engagement with the driven gear 20, whereby the driven gear 20 is disconnected from the servomotor 10. The stylus shaft 15 is prevented by a pin 19 from rotating about its own axis.

A safety template 14 is disposed in confronting relation to the stylus 16 on the distal end of the stylus shaft 15. The safety template 14 has a profile identical with that of the grinding wheel 4 to be trued by the truer 7, and is fastened to a holder 13 mounted on the grinding wheel base 1. While the grinding wheel is being trued, the stylus 16 moves along the template 14 in synchronism with movement of the truer 7 as the stylus 16 faces the template 14 with a small gap $\Delta G$ therebetween.

The clutch device will be described in more detail. The clutch device serves to disconnect the stylus shaft 15 from the truer shaft 5 when the truer 7 is to be advanced for truing infeed. Thus, with the clutch device being actuated, only the truer shaft 5 can be moved a given interval in the forward direction to impart a truing infeed movement to the truer 7 while at the same time the stylus 16 and the template 14 remain spaced properly.

As described above, the intermediate gear 23 normally held in mesh with the drive and driven gears 21, 20 is fixedly mounted on the clutch shaft 22 that is axially shiftable in response to actuation of the clutch unit. The driven gear 20 is of such a large width that it is kept in mesh with the intermediate gear 23 at all times even when the latter is shifted. The drive gear 21 has a width which is small enough to allow it to be disengaged from the intermediate gear 23 when the latter is shifted. The intermediate gear 23 is normally urged by a spring 24 in a direction to mesh with the drive gear 21. The intermediate gear 23 can therefore be disengaged from the drive gear 21 by being axially shifted against the resiliency of the spring 24. A mechanism for shifting the clutch shaft 22 comprises an intermediate shaft 26 vertically mounted in the body 2 for rotatation about its own axis extending normally to the axes of the truer ram 5 and the stylus shaft 15, a first lever arm 27 fixed at one end thereof to an upper end of the intermediate shaft 26 and having the other end held against an abutment 25 on one end of the clutch shaft 22, and a second lever arm 28 fixed at one end thereof to a lower end of the intermediate shaft 26 and having the other end engaging an engagement pin 29 projecting upwardly from the grinding wheel base 1. The engagement pin 29 is located such that when the body 2 is laterally displaced to a position in which the truer 7 and the grinding wheel 4 are spaced from each other and truer 7 is to be advanced for truing infeed, the second lever arm 28 engages the engagement pin 29 to thereby be angularly moved.

Operation of the truing apparatus of the foregoing construction is as follows: The body 2 is reciprocatively moved by the feed screw 30, rotated by the servomotor 40, in a lateral direction parallel to the axis of the grinding wheel 4. The truer shaft 5 is moved back and forth through the feed screw shaft 12 by the servomotor 10 which rotates in forward and reverse directions, thus displacing the truer 7 back and forth in a pattern conforming with the profile of the grinding wheel 4 to be trued. Such movement of the truer 7 following the contour of the grinding wheel 4 is effected by the servomotors 40, 10 under the control of a numerical control unit.

The stylus shaft 15 is moved back and forth by the servomotor 10 through the drive gear 21, the intermediate gear 23, the driven gear 20, and the feed screw shaft 17 in the same pattern as that of reciprocative movement of the truer ram 5, thereby allowing the stylus 16 to move along the template 14 with the clearance $\Delta G$ left therebetween. When the servomotor 10 runs out of control for some reasons while the grinding wheel 4 is being trued by the truer 7, the stylus 16 is brought into engagement with the template 14 to thereby prevent the truer ram 5 from forwardly moving and the body 2 from laterally moving. Accordingly, the truer 7 and the grinding wheel 4 are protected from damage and destruction which would otherwise be occasioned by excessive feeding of the truer 7 against the grinding wheel 4.

When the truing of the grinding wheel 4 is required, a truing infeed movement must be given to the truer 7. If the stylus shaft 15 is advanced in response to such a truing infeed movement of the truer 7, then the stylus 16 would no longer remain properly spaced from the template 14. To avoid this, the stylus shaft 15 needs to be disconnected from the truer shaft 5, and only the truer shaft 5 must be advanced for truing infeed.

According to the present invention, the body 2 is laterally moved to a position in which the truer 7 is laterally spaced from the grinding wheel 4. In such a displaced position, the second lever arm 28 engages the engagement pin 29 projecting on the grinding wheel base 1 and is angularly moved by the relative movement between the body 2 and the engagement pin 29. The turning motion of the second lever arm 28 causes the first lever arm 27 to be angularly moved through the intermediate shaft 26, and this results in axially shifting the clutch shaft 22 against the force of the spring 24 until the intermediate gear 23 is displaced out of mesh with the drive gear 21 to thereby disconnect the intermediate gear 23 and hence the driven gear 20 from the servomotor 10.

After the truer 7 has been advanced for truing infeed with the stylus shaft 15 being disconnected from the truer ram 5 against synchronized movement, the body 2 is displaced laterally back to bring the truer 2 toward the grinding wheel 4. The second lever arm 28 is then disengaged from the engagement pin 29, allowing the clutch shaft 22 to move back to the original position under the resiliency of the spring 24, whereupon the intermediate gear 23 meshes with the drive gear 21 again to enable the stylus shaft 15 to move in synchronism with the truer ram 5.

In the foregoing embodiment, the minimum unit depth of the infeed movement given to the truer 7 is equal to an angular displacement of the intermediate gear 23 of the clutch device by one tooth thereon. However, in the case where the unit depth is smaller, the number of the infeed movements is counted, and when a cumulative infeed depth through the infeed movements amounts to the infeed depth corresponding to one tooth, the drive gear 21 is turned back through the angular interval equal to one tooth and then the clutch device is connected to bring the intermediate gear 23 into mesh with the drive gear 21, with the result that the safety template 14 and the stylus 16 can maintain the original space therebetween.

With the arrangement of the present inveintion, the apparatus includes a stylus movable in response to movement of a truer in the same pattern as that of the movement of the truer, and a template disposed in confronting relation to the stylus with a gap left therebetween. The truer is controlled in its motion by servomotors driven in response to a command issued from a numerical control unit. When the truer is caused by the numerical control unit to move out of control for some reasons, the stylus is brought into engagement with the template, thereby protecting the truer and a grinding wheel being trued thereby against damage which would otherwise result from such uncontrolled movement of the truer. According to the present invention, grinding wheel truing can be numerically controlled by an arrangement which is free from the conventional mechanism that is complex and difficult to adjust. When the truer is to be advanced for truing infeed, the stylus is disconnected by the clutch device from the truer, and only the truer is moved in the forward direction while maintaining a proper gap between the stylus and the template.

Although a certain preferred embodiment has been shown and described, it should be understood that many changes and modifications may be made therein without departing from the scope of the appended claims.

What is claimed is:

1. An apparatus for truing a grinding wheel having a grinding surface, comprising:

a base;

a support movably mounted on said base for movement in a first direction parallel to the grinding surface;

a carrier movably supported on said support for movement in a second direction perpendicular to said first direction;

a truer supported on said carrier;

first and second numerically controlled means for respectively moving said support and said carrier during a truing operation in which the grinding wheel is trued by said truer;

a stylus supported on said support and movable in said second direction;

synchronous drive means for moving said stylus in synchronism with the movement of said carrier during the turing operation;

means for disconnecting said synchronous drive means only during an infeed operation at a position lateral of said grinding wheel; and a safety template mounted on said base in confronting relation to said stylus with a gap continually defined therebetween during a normal truing operation, said safety template having a profile corresponding to said grinding wheel, whereby said stylus can abut against the said template only when said carrier is excessively fed toward the grinding wheel due to malfunction of said second feed means, thereby preventing said stylus and said carrier from further moving toward the grinding wheel.

2. An apparatus according to claim 1, wherein said means for disconnecting said synchronous drive means is incorporated in said synchronous drive means and comprises clutch means for disconnecting said stylus from said carrier against synchronous movement thereof to prevent said stylus from moving toward said safety template when said carrier is fed by said second feed means for truing infeed against the grinding wheel prior to the truing operation.

3. An apparatus according to claim 2, wherein said clutch means comprises a clutch element, and a clutch actuating mechanism responsive to movement of said support relative to said base for actuating said clutch element to disconnect said stylus from said carrier against synchronous movement thereof when said support is in a predetermined position in which said truer is disengaged from the grinding surface.

4. An apparatus according to claim 3, wherein said synchronous drive means further includes a first gear rotatably supported on said support and rotatable by said second feed means, a second gear rotatably supported on said support for transmitting motion to said stylus in said second direction, and a third gear rotatably supported on said support and serving as said clutch element, said third gear being movable between a first position in which said third gear is held in mesh with said first and second gears and a second position in which said third gear is held out of mesh with at least one of said first and second gears.

5. An apparatus according to claim 4, wherein said clutch actuating mechanism comprises a clutch shaft supporting said third gear and axially movably supported on said support for moving said third gear between said first and second positions, means for urging said clutch shaft to hold said third gear in said first position, stop means on said base, and a swingable lever arm mechanism swingably supported on said support for being engaged and turned by said stop means to axially move said clutch shaft against the force of said urging means when said support is in said predetermined position.

6. An apparatus according to claim 5, wherein said second feed means comprises a first feed screw shaft rotatably supported on said support and threaded in said carrier, said first gear being fixedly mounted on said first feed screw shaft, and a servomotor mounted on said support for rotataing said first feed screw shaft about its own axis, said synchronous drive means further including a second feed screw shaft rotatably supported on said support and threaded in said stylus, said second gear being fixedly mounted on said second feed screw shaft.

7. An apparatus according to claim 6, wherein said truer includes a truing tool rotatable about an axis extending in said first direction, and a drive motor mounted on said carrier for rotating said truing tool.

8. An apparatus according to claim 6, wherein said safety template has a profile conforming with the grinding surface.

9. An apparatus according to claim 6, wherein said first feed means comprises a third feed screw shaft rotatably supported on said base and threaded in said support, and a servomotor mounted on said base for rotating said third feed screw about its own axis.

10. An apparatus according to claim 1, wherein said truer includes a truing tool rotatable about an axis extending in said first direction, and a drive motor mounted on said carrier for rotating said truing tool.

11. An apparatus according to claim 1, wherein said safety template has a profile conforming with the grinding surface.

* * * * *